US006067974A

United States Patent [19]

Islas

[11] Patent Number: 6,067,974

[45] Date of Patent: May 30, 2000

[54] COMPOUND BOW

[76] Inventor: John J. Islas, 8504 Sextant Dr., Baldwinsville, N.Y. 13027

[21] Appl. No.: 09/263,430

[22] Filed: Mar. 4, 1999

Related U.S. Application Data

[60] Provisional application No. 60/076,873, Mar. 5, 1998.

[51] Int. Cl.[7] ..... F41B 5/10

[52] U.S. Cl. ..... 124/25.6; 124/900

[58] Field of Search ..... 124/23.1, 24.1, 124/25.6, 86, 88, 900

[56] References Cited

U.S. PATENT DOCUMENTS

| | | | |
|---|---|---|---|
| D. 77,892 | 3/1929 | Cowdery | 124/23.1 X |
| 1,877,273 | 9/1932 | Cowdery | 124/23.1 |
| 4,287,867 | 9/1981 | Islas | 124/25.6 |
| 4,519,374 | 5/1985 | Miller | 124/25.6 |
| 4,781,168 | 11/1988 | Lester | 124/25.6 |
| 4,858,588 | 8/1989 | Bozek | 124/25.6 |
| 5,205,267 | 4/1993 | Burdick | 124/24.1 |
| 5,388,564 | 2/1995 | Islas | 124/25.6 |
| 5,499,618 | 3/1996 | Thompson | 124/25.6 |

FOREIGN PATENT DOCUMENTS

| | | | |
|---|---|---|---|
| 815921 | 7/1959 | United Kingdom | 124/23.1 |

*Primary Examiner*—John A. Ricci

*Attorney, Agent, or Firm*—Trapani & Molldrem

[57] ABSTRACT

An compound archery bow has a riser with upper and lower limbs, a bowstring connecting outboard ends of the limbs, and synchronizing pulleys for ensuring equal flexing of the limbs. The upper and lower limbs each have an inner spring limb or power limb affixed to the riser; and an outer rigid limb or recurve limb. A hinge member pivotally joins the outboard end of the spring limb in line with the inboard end of the rigid recurve limb. A pair of cam plates are affixed to the recurve limb at its inboard end, and there are left and right cam members on the riser and coupled to rotate with the synchronizing pulley. Left and right cam cables extend over the left and right cam members, respectively, and then over the associated left and right cam plates. The cam cables cooperate with the cam members and cam plates to establish the draw characteristics of the bow. The recurve limb can have a recurve of e.g. 135 degrees, and can be of a T-beam construction, with a transverse web and a flange that extends to the inside of the curve defined by the web. The rigid recurve member can be forged of aluminum or can be a plastic resin.

24 Claims, 4 Drawing Sheets

COMPOUND BOW

This application is based in part on my co-pending Provisional Pat. Application Ser. No. 60/076,873, filed Mar. 5, 1998, and which is incorporated herein by reference.

BACKGROUND OF THE INVENTION

This invention is directed to the field of archery, and more specifically to compound bows of the type employing cams and control cables to achieve a programmed draw weight, and the latter being variable with draw length. The invention is more particularly concerned with improvements to such compound bows which make the bows more compact and streamlined, and which permit the archer to select the bow's draw characteristic, and which increases the bow's shooting performance.

A bow of this general type is described in my earlier U.S. Pat. No. 5,388,564. That patent is incorporated herein by reference. Archery bows with programming means incorporated into them to regulate draw weight are also described in U.S. Pat. Nos. 3,854,417; 3,923,035; 3,486,495; and 4,287,867. These bows have means to regulate their draw weight so that a maximum pull weight is attained at an intermediate draw position, and with the draw weight dropping to some fraction of full draw weight at the full draw position. It is also an objective of such bows to transfer as much of the energy stored in the bow to the arrow, so that the arrow will fly faster and farther for a given draw weight. These have been difficult to achieve.

Current state of the art hunting bows, for example the Oneida Labs X80 models sold since about 1994, have a hinge connecting the rigid outer limb to the end of the power limb, so that the proximal end of the outer limb projects past the end of the power limb, and has to lie on top of the power limb when the bow is in the released condition. When the bow is drawn, the proximal end of the outer limb swings up above the power limb. This creates one more part of the bow that can catch on brush or clothing, and also detracts from any attempt to give the bow a streamlined appearance.

Also in the prior art bow, the cable that runs from the cam (and synchronizing wheel) up to the outer limb is fixed to a point on the outer limb. When the bow is drawn, the cable bends at the point where it is affixed, and the cable fatigues and eventually will fail at that point. When this occurs, the bow has to be returned for refitting with a new cable. If this happens in the field, it can spoil a hunting trip.

OBJECTS AND SUMMARY OF THE INVENTION

Accordingly, it is an object of this invention to provide an improved compound bow that avoids the drawbacks present in the bows of the prior art.

It is another object to provide a bow that is smaller, more streamlined in appearance, and without unnecessary projections that can catch on brush or clothing.

It is a further object to provide a compound bow that can be programmed easily to change its draw characteristics.

It is still a further object to provide a bow in which the control cables roll over cam surfaces and do not have to bend sharply at any single point, thus avoiding a major cause of cable failure.

It is yet a further object to provide a quad-cam action for the compound bow that transfers more energy from the bow to the arrow, and which is quieter than earlier compound bows.

It is still another object of this invention to provide an improve, smaller, lightweight rigid outer limb.

It is yet a further object to provide minimize finger pinch when the bow is fully drawn.

According to one aspect of this invention there is an improvement at the junction of the power limb with the outer or recurve limb of the compound bow, so that the inboard end of the recurve limb is hinged so as to be positioned in line with the outboard end of the power limb. Also, the shape and arrangement of the cams gives the bow a streamlined shape, and yet permits greater control over draw weight. The outer limb is configured to have a greater recurve, i.e., over 90° and favorably about 135°, and can be forged, e.g., from aluminum, or molded, e.g., from resin, as a rigid lightweight member.

An archery bow of this invention has a riser, or handle portion, having an upper end and a lower end. There are upper and lower limbs each having an inboard end affixed respectively to the upper and lower ends of the riser. A bowstring connects outboard ends of said upper and lower limbs, and synchronizing means for ensuring equal flexing of said upper and lower limbs upon draw and release of said bowstring. The synchronizing means can typically comprise upper and lower synchronizing wheels mounted on the riser, and carrying a synchronizing cable so that they turn together. In the bow, for each of the upper and lower limbs there is an inner spring limb member and an outer rigid limb member, i.e., a recurve limb member. An inboard end of the spring limb member is affixed to the respective end of the riser. The outer rigid limb member has its an inboard end hingedly attached to the outboard end of the spring or power limb member, and the bowstring is attached to its outboard end. A hinge member pivotally joins the outboard end of the spring limb member and the inboard end of the recurve limb member. There are a pair of cam plates rigidly disposed at left and rights sides of the rigid limb member at its inboard end. These cam plates can be unitarily formed with the outboard side of the hinge member, and in some embodiments the hinge member and cam plates can be formed unitarily with the outer limb member. There are also left and right cam members on the riser and these are coupled to rotate with the action of the synchronizing means. Favorably, these are mounted coaxially with the respective synchronizing wheel. There are left and right flexible inextensible control cables extending from the left and right cam members, respectively, and passing over the periphery of the associated left and right cam plates. The cam plates can be made regular in shape, for optimal design characteristics and to avoid having projections extend from the bow. The programming then can be carried out with the inboard cam members, which can also include a replaceable or interchangeable cam insert, the latter being field-adjustable to change the draw weight, as need be. Thus, the control cables cooperate with the cam members and associated cam plates to determine the draw characteristics of the bow.

In a preferred arrangement, the rigid outer limb member is forged of a lightweight metal. The outboard portion of the hinge and the cam plates can all be unitarily formed with the lightweight metal outer limb member. The outer limb member can have a T-beam construction comprising a transverse web and a flange that extends from the center of the web to the inside of the curve defined by the web. This rigid limb member preferably has a recurve exceeding 90 degrees, and in a favorable embodiment, 135 degrees. Alternatively, the outer limb member may be molded of a suitable plastic resin, either with or without a metal insert or core. The outer limb member can be a ring-shaped member, which rotates for some or all of the bow action on a nearly constant radius, from the point of view of the point of contact with the bowstring. The shape of the outer limb member achieves an optimal acceleration of the bow string and arrow, so that more of the bow's energy is transferred as kinetic energy to the arrow. This also gives the bow a quieter action.

The above and many other objects, features, and advantages of this invention will present themselves to persons skilled in this art from the ensuing description of preferred embodiments of this invention, as described with reference to the accompanying Drawing.

DETAILED DESCRIPTION OF THE PREFERRED EMBODIMENT(S)

Figure 1:
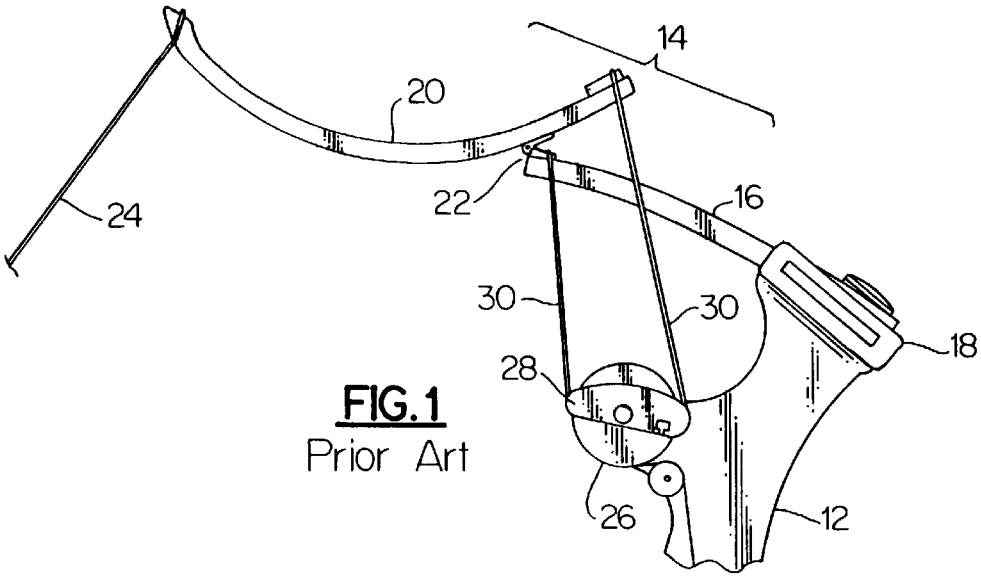
FIG. 1 Prior Art
FIGS. 1 and 2 are schematic views of the upper part of a prior art compound bow, and of a bow according to an embodiment of this invention, the respective lower parts being of similar construction.

With reference to the Drawing, FIG. 1 shows the upper part of a compound bow 10 according to the prior art. The lower part, being of similar construction, is omitted here. The bow 10 has a riser 12 or handle portion at its center with upper and lower limb portions attached at its upper and lower ends. The bow is considered in its normal, upright shooting orientation, as is conventional. The bow 10 has an upper limb 14 that includes a spring or power limb member 16, which is attached at its inboard end to a pylon 18 on the riser 12. A rigid outer limb member 20, or recurve limb member, is attached by means of a hinge 22 to the outboard end of the power limb member 16. The hinge 22 is attached to the outer limb member 20 a distance outward or distal of its inboard end, as shown. A bow string 24 is attached to the outer ends of the outer limb member 20 of the upper limb and the lower limb (not shown).

Synchronizing pulleys 26 are pivotally mounted on the riser 12 near the ends. A continuous synchronizing cable is reeved to the synchronizing pulleys and passes over idler wheels and through a vertical cable passage in the riser 12. The action of the synchronizing pulley and cable system is well understood, and is employed for ensuring even flexing of the upper and lower limbs.

A cam plate 28 is affixed onto the synchronizing pulley 26, and carries a cam cable 30 that has its ends affixed to the rigid outer limb portion 20, one end distal of the hinge 22 and the other end proximal thereof. The cam cable 30 may or may not be reeved to the cam plate 28. Means are employed for preventing the limb portions from becoming twisted when the string 24 is drawn, and this can be achieved by having a similar cam plate on the other side, with an associated cam cable 30.

It should be appreciated that the inboard end of the rigid limb portion 20 projects out somewhat from the hinge 22 and can catch on brush or clothing, and can interfere with the archer's carrying of the equipment through bush or through narrow passageways and trails. Also, as the ends of the cable 30 are fixed directly onto the outer limb portion, the cable is caused to bend sharply at those locations whenever the bow is drawn. This causes the cable to wear at these locations, and can result in cable failure. Also, the outer or recurve limb portion 20 has a limited amount of arc or curvature, usually well below 90 degrees. Thus when the bow is drawn, the string angle, at the location where the arrow is notched, can be quite steep. This can result in finger pinch.

Figure 2:
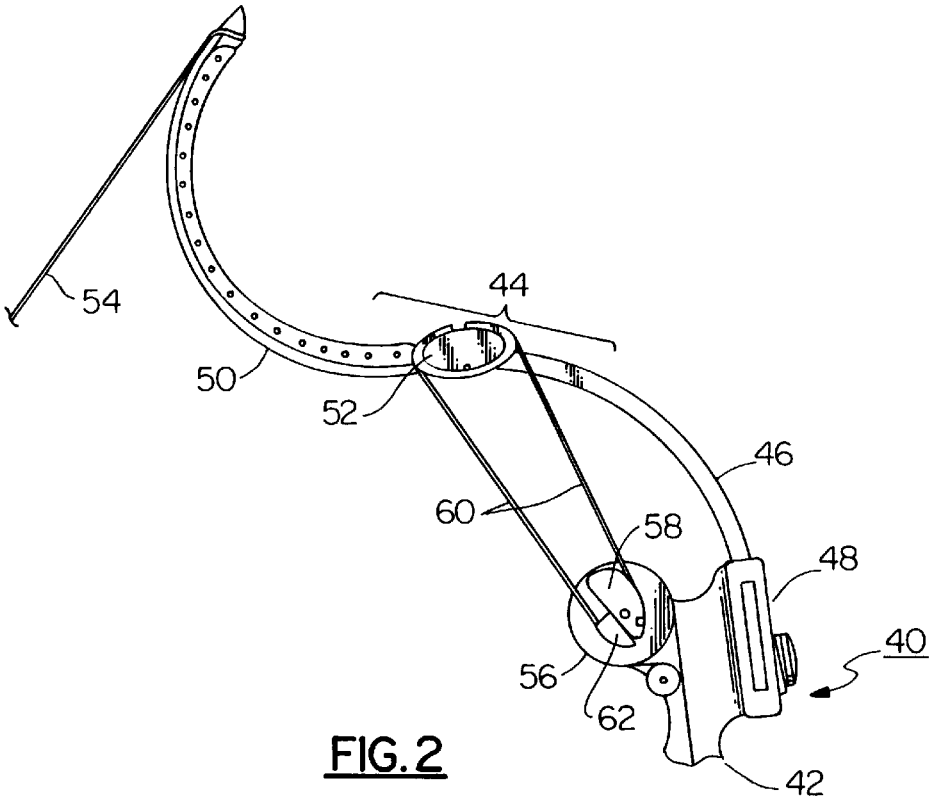

An improved compound bow 40 according to one embodiment of this invention is illustrated in FIG. 2, where an upper portion of the bow 40 is shown, and the lower portion, of similar construction, is omitted in this view. Here the bow has a riser 42 with an upper limb 44 formed of a inner resilient spring member or power limb 46 and an outer rigid member or recurve limb 50. The power limb 46 is affixed at an anchor point 48 at the upper end of the bow riser 42. In this case, the spring arm is curved at a greater arc than in the prior art, so the anchor point can be positioned lower on the riser, and nearer to and parallel with the riser. A bow string 54 is attached at the outboard ends of the upper recurve limb portion 50 and the lower recurve limb portion (not shown). The recurve limb 50 is attached by means of an in-line hinge to the outboard end of the power limb 46, with left and right cam plates 52 mounted on the hinge at the side of the recurve limb 50. Here, only the right cam plate is shown, as the hinge and the left cam plate are obscured in this view. It should also be noticed that the recurve limb has an arc of well over ninety degrees, and in this embodiment about one hundred thirty-five degrees. In some embodiments, the outer limb can be a ring or nearly a full ring, in which case there can be a reinforcing or stiffening web across it.

There is a synchronizing wheel or pulley 56, similar to the pulley 26 of FIG. 1, with associated guide pulleys and synchronizing cable, in the same fashion as is usually practiced. Here there is a right adjustable cam member 58 affixed on the synchronizing wheel 50, with a similar left cam member (not shown here) positioned on the other side. A flexible but inextensible cam cable 60 passes over grooves in the cam plate 52 and grooves in the rim of the cam member 58, and is here anchored to a point on the cam member 58. A portion of the cam member 58 is formed as an insert 62, which can be replaceable with another insert of different shape in order to adjust the draw characteristics of the bow. Also, the position of the insert may be shifted on the synchronizing wheel to make small adjustments to the draw of the bow.

The in-line hinge connects the power limb with the recurve or outer limb, thereby keeping the end of the power limb and the end of the outer or recurve limb aligned. This eliminates much of the torque-induced twisting of the outer limb. This construction also gives the bow a more streamlined appearance. Moreover, this construction requires somewhat less material than the prior art construction, and also provides a curved surface for the cable to ride upon, thus reducing bow string fatigue and wear from use. The lower part of the riser is fitted with similar parts.

Figure 3:
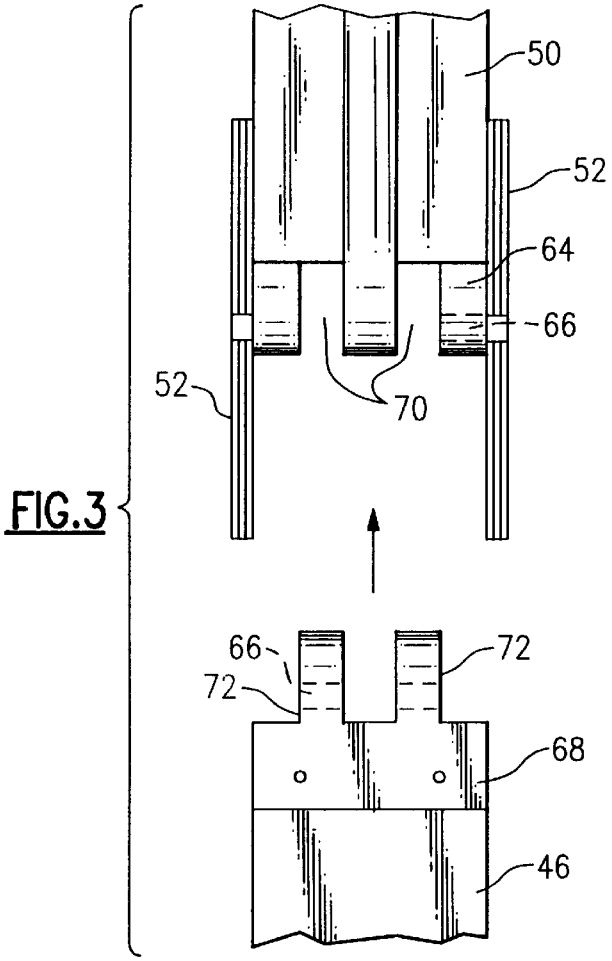
FIG. 3 is a top assembly view of the hinge and cam plates of the upper limb of this embodiment.
Figure 4:
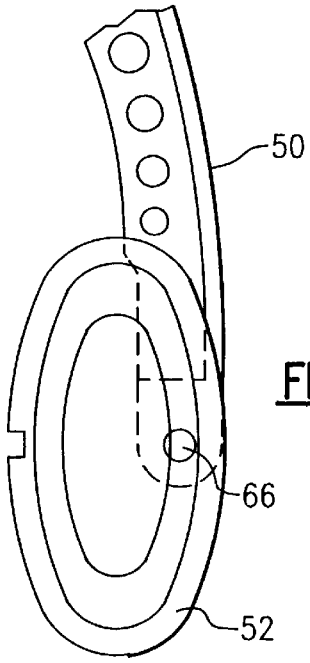
FIGS. 4 and 5 are side views of respective portions of the hinge and cam plates of FIG. 3.
Figure 5:
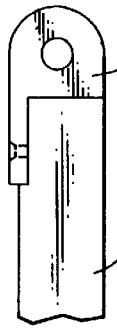

The bow hinge is shown in plan in FIG. 3 and in side elevations in FIGS. 4 and 5. An outer hinge portion 64 is affixed onto the end of the outer or recurve limb 50. In this embodiment, the hinge portion 64 is unitarily formed with the left and right cam plates 52 and with the recurve limb 50. (The recurve limb here is formed of metal.) This unitary construction achieves better stability and prevents the hinge portion from coming loose from the recurve limb member. A keyway or eye 66 passes through the hinge member to receive a hinge pin (not shown here). The inner portion of the hinge 68 is fitted onto the spring limb member, here with screws or similar fasteners, and is joined to the first hinge member 64 with the aforesaid hinge pin. The outer hinge portion 64 has notches 70 to receive the mating parts 72 of the inner hinge member 68. Of course, in other embodiments, the outer hinge portion can be formed as a separate member from the recurve limb member, and can be attached to it with conventional fasteners. There are eyes or keyways 66 through the two hinge portions 64, 68 receive the hinge pin so that when the hinge joins the power and outer limbs, they are aligned with one another. Also, as the cable passes over and rides in the cam grooves 52, 58, stress is relieved from the ends of the cable, and cable wear is reduced significantly. The positioning of identical sets of cam members on the right and left sides of the hinge member keeps the torsion even on the outer limb member so that there is no tendency to twist. This quad cam configuration, with matching cams on each side of the bow, lets the cams have gentler curves, which also reduces cable wear.

Figure 6:
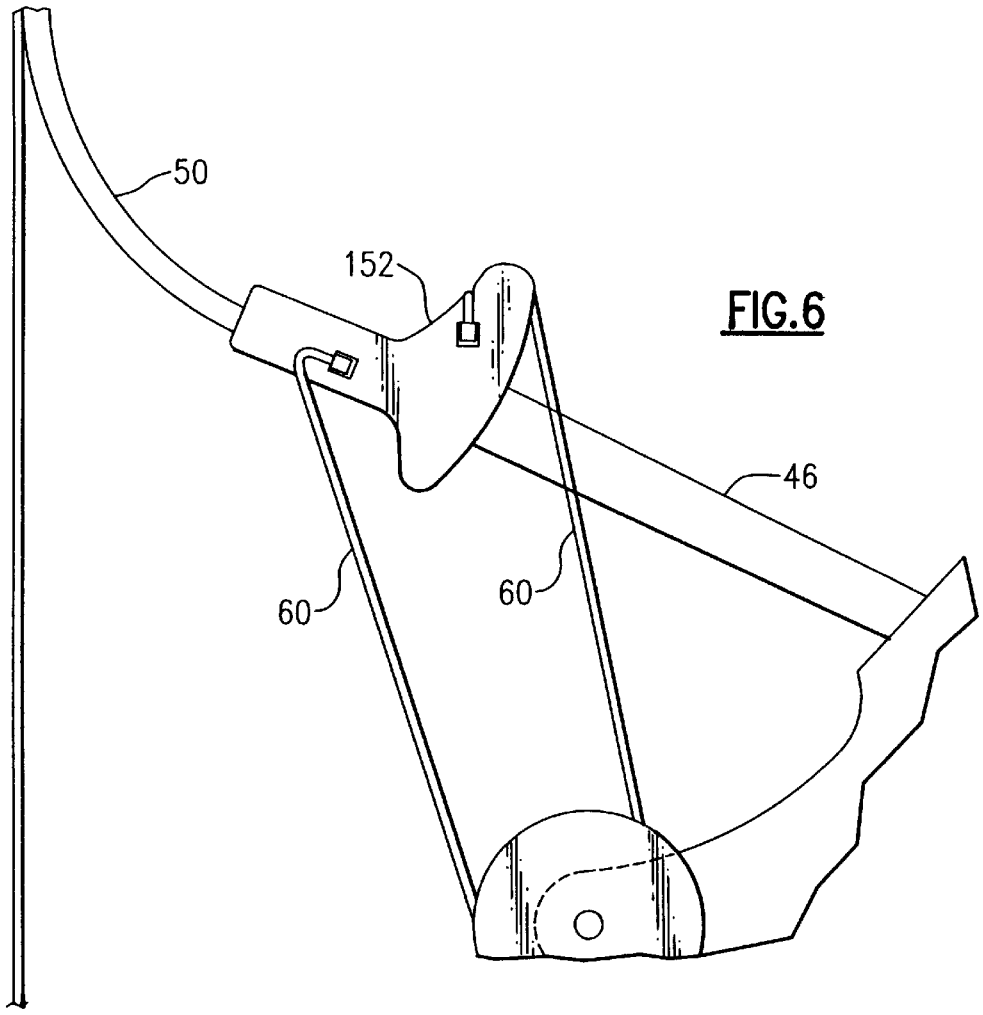
FIG. 6 shows a cam configuration according to another possible embodiment.
Figure 7:
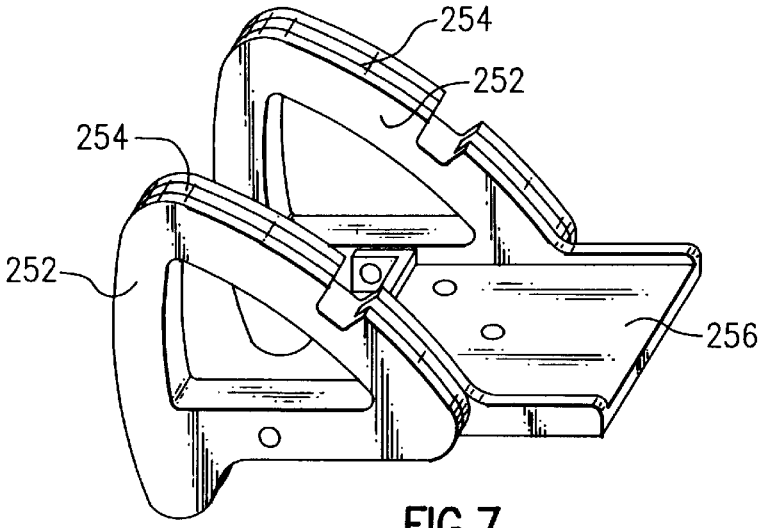
FIG. 7 shows a cam and hinge arrangement of a further embodiment.

FIGS. 6 and 7 show other possible embodiments of this invention in which the shape of the cam plates have been selected for a particular draw characteristic. In FIG. 6, a generally T-shaped cam plate construction is shown, with its cam plates 152 fitted in respect to the spring limb member 46 and the rigid recurve member 50, and on whose rim the cam cable 60 rides. In FIG. 7, somewhat D-shaped cam plates 252 are unitarily formed with an outer hinge portion 264, each with a groove 254 in which the cable rides. There is a recessed bed 256 that fits the end of the outer recurve limb member 50. Here the recessed bed forms a pocket with side walls that prevent any twisting of the hinge on the limb. The other hinge member has similar pocket construction. This hinge and cam member can be cut from metal extrusions.

Figure 8:
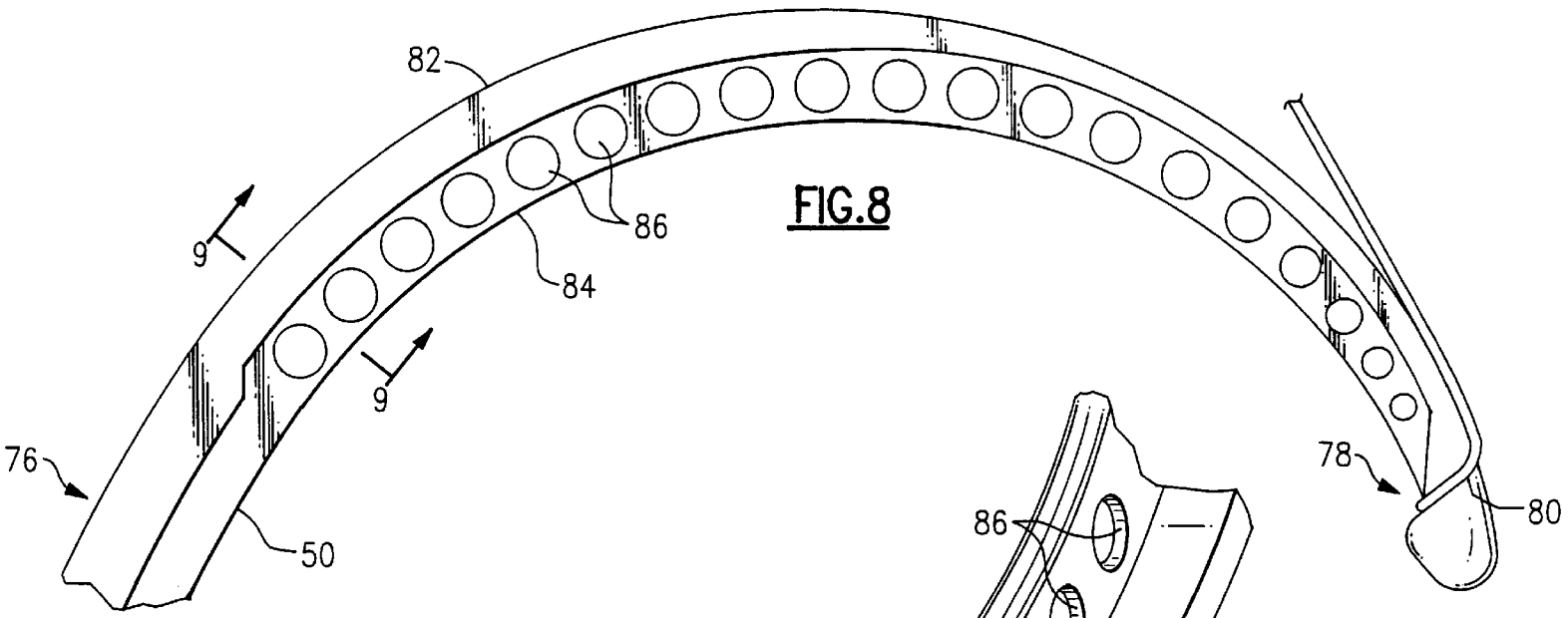
FIGS. 8 and 9 are a side view and end view of a rigid outer recurve limb portion of several preferred embodiments.
Figure 9:
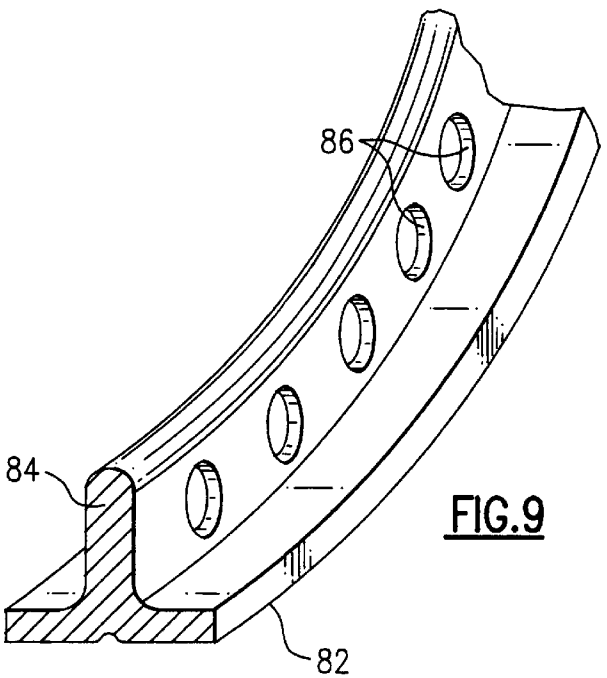
Figure 10:
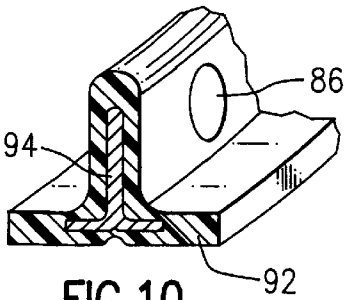
FIG. 10 is an end view of a recurve limb of an alternative embodiment.

Another aspect of the invention is directed to an improvement in the outer or recurve limb of the compound bow, as shown in FIGS. 8, 9, and 10. Current state-of-the-art hunting bows have a rigid outer limb that is attached, as described previously, at the distal end of the power limb. The rigid outer limb is usually made up of a reinforced plastic, e.g., resin with glass fibers, and has a recurve below ninety degrees. When the bowstring is drawn, the outer limb swings downward. As the bow is drawn to its full position, the outer limb continues down, shortening the length of the bow. This makes a sharper angle in the bowstring between the arrow notch and the upper and lower limbs, and can cause finger pinch if the string angle goes below ninety degrees. There are power limbs and rigid outer limbs at both the upper and lower ends of the bow.

Here an important improvement lies in the outer limb portion 50, as shown in FIGS. 9 and 10. The rigid outer limb 50 in this embodiment is forged of a lightweight metal, e.g., aluminum or magnesium, with a T-beam construction, as shown generally in FIG. 9. Here, the proximal end 76 of the outer limb 50 attaches by means of the bow hinge, as discussed before, to the distal end of the spring limb or power limb. Its distal end 78 has a groove 80 to receive the bowstring 54. Here, the recurve, i.e., the amount of arc, is well over ninety degrees, and can be about 135 degrees. The T-beam construction comprises a transverse web 82 and a flange 84 that extends from the center of the web 82 to the inside of the curve. Here the flange 84 has cutouts or perforations 86 to relieve some of the mass of the limb without reducing its rigidity. As an alternative, as shown in FIG. 10, a rigid recurve limb portion 92 could be compression molded from a suitable plastic resin, either with or without a metal core, here shown as an inner metal member 94 of T-shaped profile, thereby making the outer recurve limb portion 92 more economical to manufacture.

The increased recurve results in a shorter outer limb, which makes the bow more compact and easier to carry. The increased recurve angle means that the bow does not shorten as much when the bowstring is drawn and this reduces the amount of finger pinch in the bowstring. The lighter weight reduces the inertia of the outer limb, increasing bow performance on release. The T-beam outer limb is also stiffer than the conventional outer limb. The shape of the recurve creates a constant moment arm through all or most of the action of the bow limb, if it has a constant or more nearly constant radius off the axis of curvature. Moreover, the reduced size of the bow permits it to fit easily into a case designed as a gun case, which can be smaller and also less expensive than a bow case.

While the invention has been described and illustrated in respect to a few selected preferred embodiments, it should be appreciated that the invention is not limited only to those precise embodiments. Rather, many modifications and variations would present themselves to those of skill in the art without departing from the scope and spirit of this invention, as defined in the appended claims.

I claim:

1. An archery bow comprising a riser having an upper end and a lower end, upper and lower limbs each having an inboard end affixed respectively to the upper and lower ends of the riser, a bowstring connecting outboard ends of said upper and lower limbs, and synchronizing means for ensuring equal flexing of said upper and lower limbs upon draw and release of said bowstring; each of said upper and lower limbs having a quad cam configuration, and including an inner spring limb member having an inboard end affixed to the respective end of said riser, and an outboard end;

an outer rigid limb member having an inboard end and an outboard end to which said bowstring is attached;

a hinge member pivotally joining the outboard end of said spring limb member and the inboard end of said rigid limb member;

a pair of outboard cam plates rigidly disposed at left and right sides of the rigid limb member at the inboard end thereof;

left and right inboard cam members on said riser and coupled to rotate with said synchronizing means; and left and right flexible inextensible cam cables extending from said left and right inboard cam members, respectively, and passing over a periphery of the associated left and right outboard cam plates;

said cam cables cooperating with said inboard cam members and associated outboard cam plates to determine draw characteristics of said bow.

2. An archery bow according to claim 1 wherein an outboard portion of said hinge and said cam plates are unitarily formed with said outer limb member.

3. An archery bow according to claim 1 wherein said cam plates are formed unitarily with a portion of said hinge member.

4. An archery bow according to claim 1 wherein said outer limb member is formed of a lightweight metal.

5. An archery bow according to claim 4 wherein an outboard portion of said hinge and said cam plates are unitarily formed with said lightweight metal outer limb member.

6. An archery bow according to claim 1 wherein said outer limb member has a recurve exceeding 90 degrees.

7. An archery bow according to claim 6 wherein said outer limb member has a recurve of about 135 degrees.

8. An archery bow according to claim 1 wherein said synchronizing means includes a synchronizing wheel that is coupled by a synchronizing cable to turn with another synchronizing wheel at the other end of the bow riser, and said left and right cam members are rigidly mounted on said synchronizing wheel.

9. An archery bow according to claim 8 wherein said cam members have replaceable inserts therein to permit changing of the draw characteristics of the bow.

10. An archery bow comprising a riser having an upper end and a lower end, upper and lower limbs each having an inboard end affixed respectively to the upper and lower ends of the riser, a bowstring connecting outboard ends of said upper and lower limbs, and synchronizing means for ensuring equal flexing of said upper and lower limbs upon draw and release of said bowstring; each of said upper and lower limbs including an inner spring limb member having an inboard end affixed to the respective end of said riser, and an outboard end;

an outer rigid limb member having an inboard end and an outboard end to which said bowstring is attached;

a hinge member pivotally joining the outboard end of said spring limb member and the inboard end of said rigid limb member;

a pair of cam plates rigidly disposed at left and rights sides of the rigid limb member at the inboard end thereof;

left and right cam members on said riser and coupled to rotate with said synchronizing means; and left and right flexible inextensible cam cables extending from said left and right cam members, respectively, and passing over a periphery of the associated left and right cam plates;

said cam cables cooperating with said cam members and associated cam plates to determine draw characteristics of said bow;

wherein said hinge member is an in-line hinge wherein the outboard end of the spring limb member is held in line with the inboard end of the rigid limb member.

11. An archery bow comprising a riser having an upper end and a lower end, upper and lower limbs each having an inboard end affixed respectively to the upper and lower ends of the riser, a bowstring connecting outboard ends of said upper and lower limbs, and synchronizing means for ensuring equal flexing of said upper and lower limbs upon draw and release of said bowstring; each of said upper and lower limbs including an inner spring limb member having an inboard end affixed to the respective end of said riser, and an outboard end;

an outer rigid limb member having an inboard end and an outboard end to which said bowstring is attached;

a hinge member pivotally joining the outboard end of said spring limb member and the inboard end of said rigid limb member;

a pair of cam plates rigidly disposed at left and rights sides of the rigid limb member at the inboard end thereof;

left and right cam members on said riser and coupled to rotate with said synchronizing means; and left and right flexible inextensible cam cables extending from said left and right cam members, respectively, and passing over a periphery of the associated left and right cam plates;

said cam cables cooperating with said cam members and associated cam plates to determine draw characteristics of said bow;

wherein said outer limb member has a T-beam construction comprising a transverse web and a flange that extends from the center of said web to the inside of the curve defined by the web.

12. An archery bow according to claim 11 wherein said outer limb member is forged of a lightweight metal.

13. An archery bow according to claim 11 wherein said outer limb member is molded of a suitable plastic resin.

14. An archery bow according to claim 13, wherein said outer limb member has a metal core molded into said plastic resin.

15. An archery bow according to claim 11 wherein said flange has perforations therethrough.

16. An archery bow comprising a riser having an upper end and a lower end, upper and lower limbs each having an inboard end affixed respectively to the upper and lower ends of the riser, a bowstring connecting outboard ends of said upper and lower limbs, and synchronizing means for ensuring equal flexing of said upper and lower limbs upon draw and release of said bowstring; each of said upper and lower limbs including an inner spring limb member having an inboard end affixed to the respective end of said riser, and an outboard end;

a rigid outer limb member having an inboard end and an outboard end to which said bowstring is attached;

a hinge member pivotally joining the outboard end of said spring limb member and the inboard end of said rigid limb member;

a pair of cam plates rigidly disposed at left and right sides of the rigid limb member at the inboard end thereof; and left and right flexible inextensible cam cables extending from said riser and passing over a periphery of the associated left and right cam plates to determine draw characteristics of said bow;

wherein said rigid outer limb member has a T-beam construction comprising a transverse web and a flange that extends from the center of said web to the inside of the curve defined by the web.

17. An archery bow according to claim 16 wherein an outboard portion of said hinge member and said cam plates are unitarily formed with said outer limb member.

18. An archery bow according to claim 16 wherein said outer limb member is forged of a lightweight metal.

19. An archery bow according to claim 16 wherein said outer limb member is molded of a suitable plastic resin.

20. An archery bow according to claim 19 wherein said outer limb member has a metal core molded into said plastic resin.

21. An archery bow according to claim 16 wherein said flange has perforations therethrough.

22. An archery bow according to claim 16 wherein said outer limb member has a recurve exceeding 90 degrees.

23. An archery bow according to claim 22 wherein said outer limb member has a recurve of about 135 degrees.

24. An archery bow according to claim 16 wherein said outer limb member has a shape so as to rotate for some or all of the bow action on a nearly constant radius, considered at the point of contact of the outer limb member with the bowstring.

* * * * *